United States Patent [19]

Schiffers

[11] Patent Number: 4,656,756

[45] Date of Patent: Apr. 14, 1987

[54] METHOD FOR HEAT-TREATING TEXTILE MATERIAL AND TENTER FOR CARRYING OUT METHOD

[75] Inventor: Theo Schiffers, Würselen, Fed. Rep. of Germany

[73] Assignee: H. Krantz, GmbH & Co., Aachen, Fed. Rep. of Germany

[21] Appl. No.: 817,171

[22] Filed: Jan. 9, 1986

Related U.S. Application Data

[63] Continuation of Ser. No. 636,403, Jul. 31, 1984, abandoned.

[30] Foreign Application Priority Data

Aug. 8, 1983 [DE] Fed. Rep. of Germany ..... 3328557

[51] Int. Cl.[4] ..... F26B 3/04

[52] U.S. Cl. ..... 34/25; 34/31; 34/48; 34/52; 34/155; 432/55

[58] Field of Search ..... 34/48, 52, 155, 158, 34/25, 31; 432/8, 55, 59

[56] References Cited

U.S. PATENT DOCUMENTS

| | | | |
|---|---|---|---|
| 3,259,995 | 7/1966 | Powischill | 34/52 |
| 3,955,287 | 5/1976 | Brock et al. | 34/212 |
| 4,094,077 | 6/1978 | Schrader et al. | 34/155 |
| 4,133,636 | 1/1979 | Flynn | 34/158 |
| 4,199,871 | 4/1980 | Ward | 34/25 |
| 4,299,036 | 11/1981 | Schregenberger | 34/48 |
| 4,498,248 | 2/1985 | Pabst | 34/48 |

FOREIGN PATENT DOCUMENTS

| | | | |
|---|---|---|---|
| 2721965 | 11/1978 | Fed. Rep. of Germany | 34/52 |
| 3148576 | 3/1983 | Fed. Rep. of Germany | |

OTHER PUBLICATIONS

"Melliand Textilberichte" 8/1965 p. 887.

*Primary Examiner*—Albert J. Makay
*Assistant Examiner*—David W. Westphal
*Attorney, Agent, or Firm*—Arthur B. Colvin

[57] ABSTRACT

For a method for heat-treating textile material, and for a tenter for carrying out the method, it is proposed to control the textile web velocity as a function of the point on the treatment path at which the maximum deviation in the amount of energy spent per unit time occurs. To determine this point on the treatment path it is not necessary, therefore, to measure the momentary temperature of the textile material directly or the temperatures of the treatment medium flowing in and out. Instead, it suffices to determine the individual valve positions which indicate the amounts of energy supplied per unit time, and to infer therefrom the site of the treatment path where the drying process is completed and the fixing process sets in.

5 Claims, 4 Drawing Figures

METHOD FOR HEAT-TREATING TEXTILE MATERIAL AND TENTER FOR CARRYING OUT METHOD

This application is a continuation of Ser. No. 636,403 filed July 31, 1984, now abandoned.

The invention relates to a method with maximum energy conservation and extends to a tenter for carrying out the method.

In such generally known methods, the temperatures prevailing over the treatment path are continuously being measured in order to bring about a correction of the amounts of energy spent depending on the deviations from the desired temperatures required for optimum treatment, and in order, if necessary, also to adapt the treatment speed to a mean value of the temperature deviations, so that, for example, the speed at which a textile web is passed through a tenter is reduced in the degree and for the duration in which or for which the desired temperatures are fallen short of.

It is known that under uniform drying conditions textile material maintains an almost constant temperature until a certain critical residual moisture, differing with the type of fiber, is reached, whereupon the drying rate decreases appreciably and the textile material temperature rises uniformly (cf. "Melliand Textilberichte" 8/1965, p. 887). After the fabric is completely dry, naturally there is no longer any evaporation of water, for which during the drying process a corresponding share of energy had to be spent. Thus the fabric reaches again an approximately constant temperature for the rest of the treatment time.

For the adjustment of an optimum treatment rate, by which for example the ratio of drying treatment time to fixing treatment time is determined, it is necessary to determine the point on the treatment path at which the textile material has the critical residual moisture. Because of the temperature rise occurring at this point, it has been proposed before to determine the temperature change, rather than the moisture content of the textile material, which is more difficult to measure, and from it to draw conclusions as to the moisture content of the textile material. The suggestion was made, therefore, to measure continuously the temperature of the textile material directly, but contactlessly, by means of temperature sensors.

To determine the temperature response over the length of a treatment path as accurately as possible, temperature sensors must be provided along the treatment path in correspondingly close succession. Contactless temperature sensors, such as radiation pyrometers, are very expensive, however. While their use for the determination of the temperature profile over the treatment path makes it possible to optimize the textile web velocity and hence to save energy, the investment which this requires cancels the cost advantage out again to a substantial extent. Cost-effective contactless temperature measuring devices are indeed also known (cf. "Textilbetrieb" Apr. 1981, p. 55), but they must be arranged within a boundary layer only a few millimeters thick, so that contact of the measuring devices with the textile web cannot be ruled out and markings may result on the web.

From DE-OS 31 48 576 a method for checking the continuous heat treatment of a textile web is known which is said to furnish a measurement result sufficiently accurate in the industrial practice, to permit control and/or regulation of the respective parameters on the basis of the measurement result, and which can be set up and operated at a cost fully compensated by the saving in energy and production time. For the monitoring of the continuous convective heat treatment of a textile web with continuous contactless measurement of the temperature of the web it is proposed to proceed in such a way that, as the web is being approached and/or traversed by a flow of heated air for instance parallel and/or transversely to the direction of web transport, the amount of heat proportional to the temperature of the web and yielded to the web is measured as a function of the difference between the temperature of the air impinging on the web and the temperature of the air reflected from or passing through the web.

According to this known method, therefore, the amount of heat yielded by the heated treatment medium to the textile web, which amount is proportional to the difference between the temperature of the arriving treatment medium and the temperature of the cloth, is determined as a function of the difference between the temperature of the arriving treatment medium and the temperature of the reflected or passed-through treatment medium. In measurements at several successive points on the treatment path of the inflowing and outflowing treatment medium, this method gives a temperature profile corresponding to the textile web temperature.

It is the object of the invention to optimize the treatment time in the heat treatment of textile material and to this end also to determine the temperature profile of the textile material over the treatment path, but without having to measure the momentary temperature of the textile material directly or the temperatures of the inflowing and outflowing treatment medium.

Taking as point of departure a heat treatment of textile material which is admitted by several gaseous treatment medium streams conducted substantially in circulation, the amount of energy spent per unit time for each stream of the treatment medium being measured, and a variation of this amount of energy being carried out according to the desired temperature in the respective field of the tenter, for the solution of the problem posed it is proposed according to the invention to proceed in such a way that the textile web velocity is regulated as a function of the point on the treatment path at which the maximum deviation in the amount of energy spent per unit time for two streams of successive treatment path sections occurs.

According to an especially advantageous development of the invention, the procedure may be to conduct to the fields of a tenter treatment medium first heated in no-load operation and to measure the amount of energy required per unit time for each stream to maintain the desired temperature in the fields. Thereupon the textile web to be treated is introduced into the tenter and then the amount of energy required to maintain the desired temperature in each field per unit time is likewise measured. Then the difference between the two amounts of energy of each stream is determined, and finally the textile web velocity is regulated as a function of the point of the treatment path at which the maximum deviation of the found difference values of the amounts of energy for the streams of successive fields occurs.

For the drying and immediately following fixing treatment of a textile web, the procedure can be, according to the invention, that values of the amounts of energy spent per unit time are supplied to a computer which compares the point of the treatment path of the maximum value deviation with a desired point of the treatment path, whereupon the web velocity is corrected accordingly, to maintain a given drying and likewise a given fixing time.

The method according to the invention utilizes the finding that the amounts of heat supplied are proportional for example to the degree of opening of valves of the treatment medium streams. The valve positions can be determined electrically in a manner known in itself and can be indicated for example by light-emitting diodes.

To make clear the transition point between the drying treatment and the fixing treatment, first the tenter can be heated. The temperature having been reached, a certain heat consumption adjusts itself, also at certain valve positions. The data resulting therefrom can be trimmed toward zero. In this way the no-load capacity of the tenter, that is, the proportion which results from machine-related losses, can be eliminated. After the textile web has entered the tenter, new measured values result, which correspond only to the portion for heating the textile web and for evaporating the water. In this way the transition point on the treatment path between the drying treatment and the fixing treatment can be indicated.

A tenter consisting of several drying and fixing fields, each with a fan circulating a stream of a gaseous treatment medium and with a heater which holds the stream at treatment temperature for carrying out the method of the invention, is preferably equipped so as to arrange in the circulation of the treatment medium the probe of a thermometer which is coupled with a heating regulator to which is connected a valve which varies the amount of energy flowing to the heating system per unit time and whose momentary position can be determined.

According to a variant of the tenter of the invention, the heating system consists of a heating register arranged on the suction side of the fan, or of a gas or oil burner, the probe of the thermometer being arranged in flow direction after the heating system.

Figure 1:
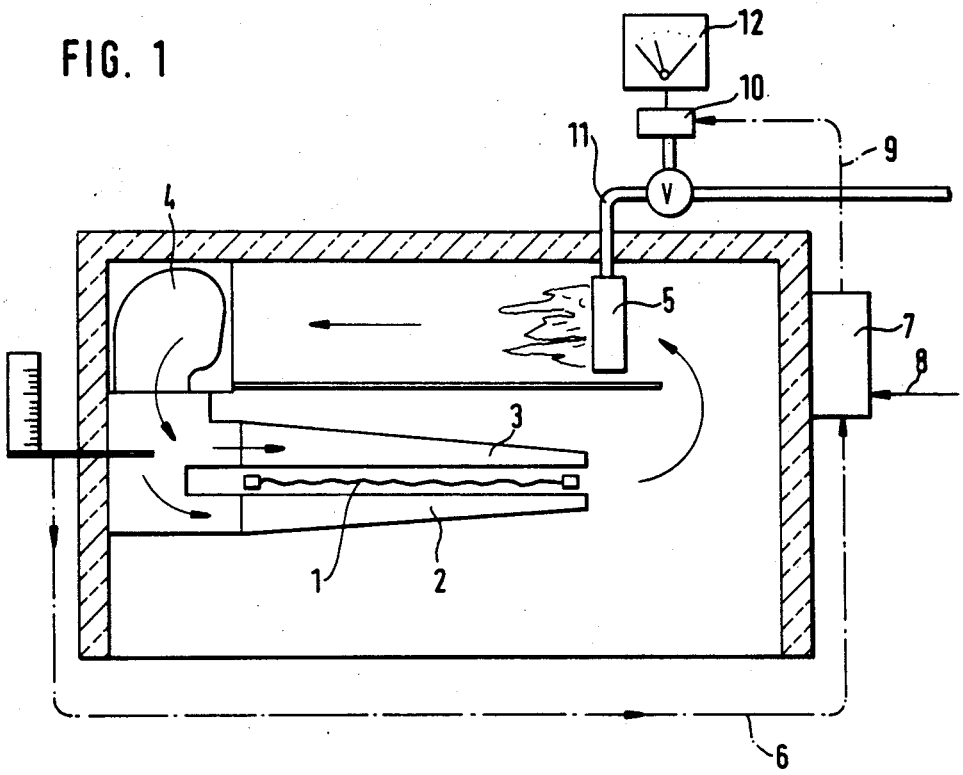
FIG. 1 shows a cross section of the invention.

To explain the invention, there is shown in the drawing an embodiment of a tenter for carrying out the method and, over a dial, graphic representations of the different amounts of energy supplied over the length of the tenter (=treatment path) and an instrument for controlling the textile web velocity.

As the cross-section, shown schematically in FIG. 1, through the field of a tenter shows, a textile web 1 is guided, stretched widthwise, between nozzle boxes 2 and 3 and is admitted with a gaseous treatment medium flowing substantially in circulation.

On the suction side of a fan 4 a burner 5 heats the treatment medium, the temperature of which is measured continuously on the compression side of the fan 4. Via a line 6 the temperature is fed as actual value to a heating regulator 7, to which is fed additionally a desired value via a line 8. Via a line 9, a heating valve 10 in a fuel feed line 11 is controlled, through which the burner 5 is supplied with a corresponding amount of fuel. The momentary position of the heating valve 10 is visualized by a dial 12.

Thus the temperature of the treatment medium is measured in flow direction after the burner 5 and before application of the medium on the textile web 1. The actual value found is compared in the heating regulator 7 with the desired value, i.e. with the set temperature. If the actual value is lower than the desired value, the heating regulator 7 opens the heating valve 10 and closes it again intermittently when the actual value is greater than the desired value.

The heat balance of the tenter is as follows:

Via the burner 5 the thermal energy is given off to the treatment medium, guided substantially in cirulation, whereby it is brought to the desired temperature. The treatment medium loses its thermal energy by the heating up of the cloth, by the heating up and evaporation of the water in the cloth, by the heating up of the primary air supplied to the circulation, and by radiation losses for example of the cloth transport chain and of the drying chamber.

As the temperature of the treatment medium drops due to the release of heat, it must be raised again to the desired temperature by heating. Thus a certain valve position of the heating system is correlated with a certain heat consumption of the tenter.

The heat balance of a drying and fixing process may, for example, be as follows:

| | Drying process per field | Fixing process per field |
|---|---|---|
| (a) Total heat requirement | 197,000 Kcal/h | 48,000 Kcal/h |
| (b) Losses through tenter chain | 7,680 Kcal/h | 7,680 Kcal/h |
| (c) Losses through drying chamber | 1,200 Kcal/h | 1,200 Kcal/h |
| (d) heating of the cloth | 9.900 Kcal/h | 4,560 Kcal/h |
| (e) Heating and evaporating of the water | 144,720 Kcal/h | — |

The heat amounts under (a), (b) and (c) constitute the no-load heat requirement of the tenter. The heat amounts under (d) and (e) are the amounts to be supplied for the cloth. It can be seen therefrom that the drying process requires a multiple of the thermal energy of the fixing process.

As each tenter field is provided with a heating valve and with a dial visualizing the valve position, there can be determined also the decrease in consumption of heating energy over the length of the treatment path from one measuring point to the next, whereby the point on the treatment path is indicated where the drying process is completed and the fixing process begins.

Figure 2:
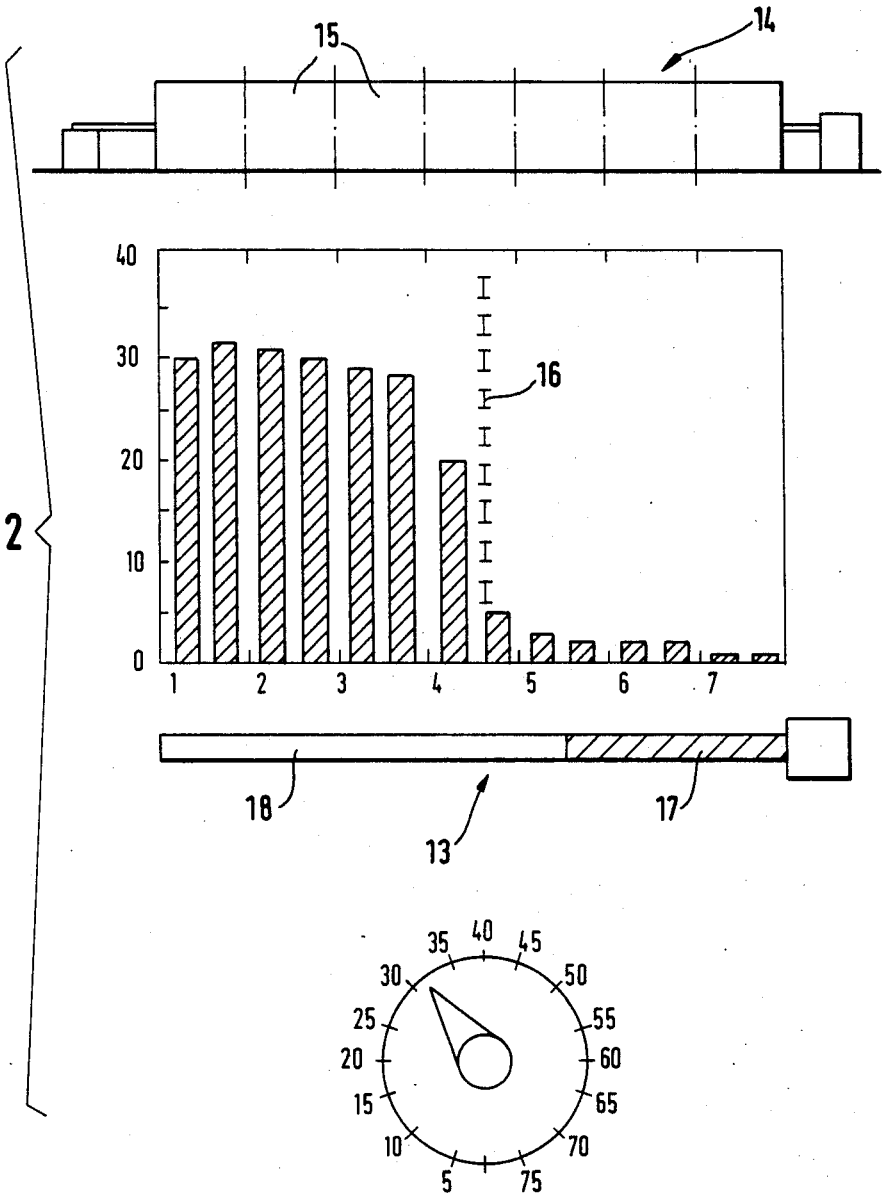
FIGS. 2, 3, and 4 show graphic representations of the energy expenditures where the fixing paths are too short, too long, and optimized, respectively.
Figure 3:
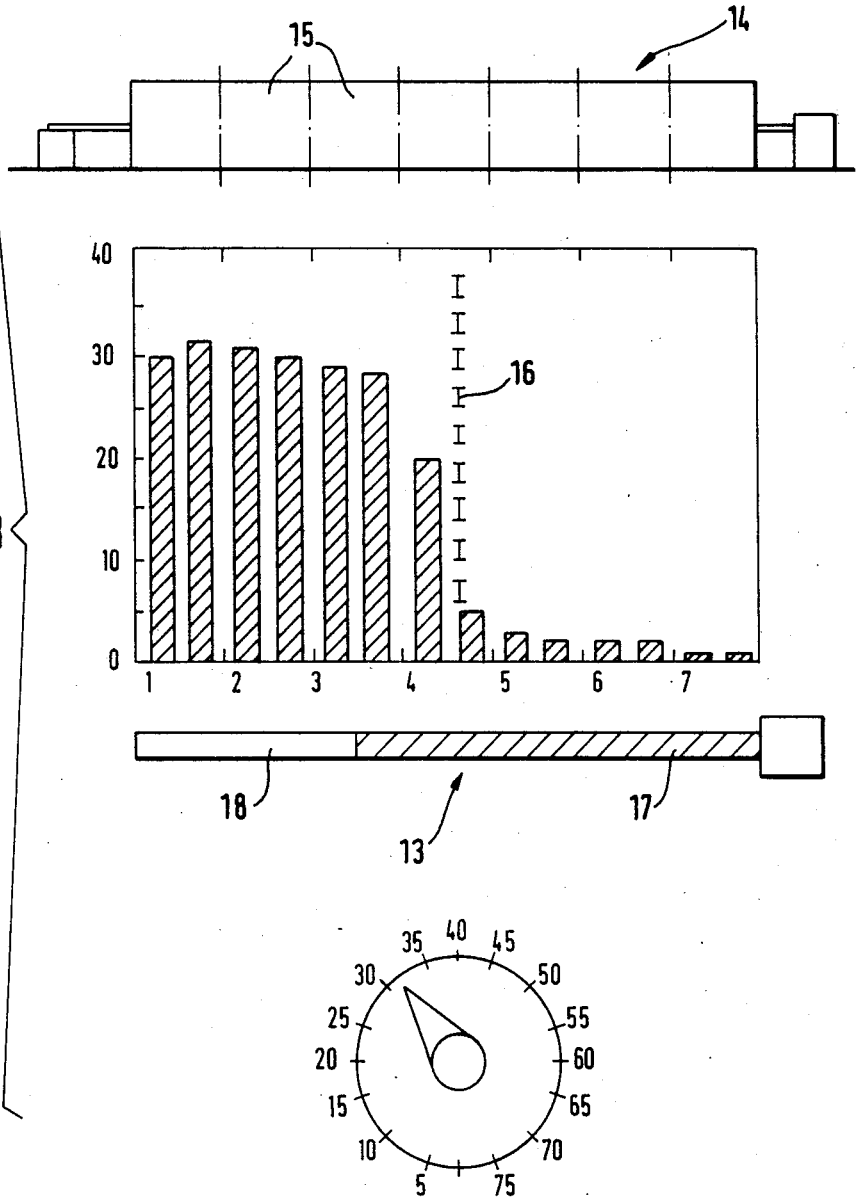
Figure 4:
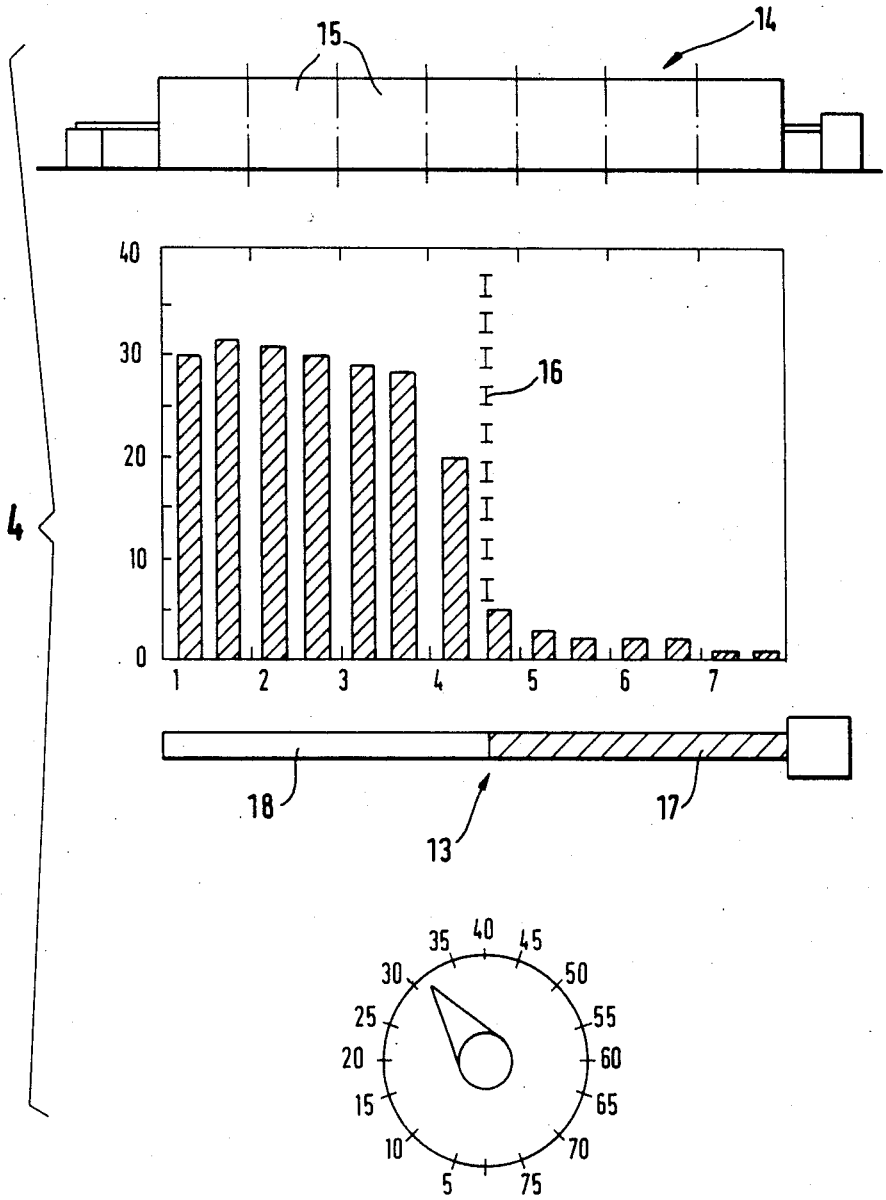

As FIGS. 2 to 4 show, a dial 13 symbolizes the length of a schematically shown tenter 14 consisting of seven fields 15 arranged successively over the treatment path.

To be able to carry out the drying and fixing treatment at an optimum textile web velocity, the transition point between drying and fixing treatment in the tenter 14 should be located at the site where the latter is intersected by a line 16.

In FIG. 2, the dial 13 shows that the chosen textile web velocity results in too short a fixing path 17, preceded by too long a drying path 18. By contrast, FIG. 3 illustrates too long a fixing path 17 and too short a drying path 18. In FIG. 4, instead, the fixing path 17 and drying path 18 are matched so that their transition is determined by line 16. In this example alone the textile web velocity is optimum, so that the drying treatment as also the fixing treatment are as short as possible but as long as necessary.

I claim:

1. The method of heat treating a textile fabric web in a tenter device to effect the drying and thereafter the fixing thereof, said tenter device including a plurality of discrete treatment fields, each said field including a valve having a regulator portion for separately regulating heating means for a stream of gaseous treatment medium circulated in said field, comprising the steps of adjusting said regulator portions to cause each said field to be heated to a desired temperature in a no-load operation, determining the setting of said regulator portions required to maintain said temperature in each of said fields at said desired temperature, advancing a sample fabric web to be treated through said tenter, readjusting the setting of said regulator portions to the degree necessary to maintain the temperature in each of said fields at said desired temperature, determining the energy consumption in each said field as a function of the difference in the settings of said regulator portions between said no-load operation and operation with said sample web to thereby ascertain the energy required for the treatment of said fabric in each said field, and thereafter adjusting the speed at which said web is advanced through said tenter as a function of the pair of adjacent fields exhibiting the greatest deviation in energy usage.

2. The method in accordance with claim 1 and including the step of feeding to a computer the said settings of said regulator portions, said speed of said web being modified responsive to the output of said computer.

3. A tenter device for the heat treatment of a textile fabric web to effect the drying and thereafter the fixing of said web, comprising a plurality of discrete treatment fields, said fields including heating means for a stream of gaseous treatment medium, heat regulator valve means having regulator portions for adjusting the fuel intake to said heating means, temperature measuring means for ascertaining the temperature in the respective fields, adjustable speed drive means for advancing a fabric web to be treated through said tenter at a selected speed, sensing means for determining the energy expended in each of said fields as a function of the position of said regulator portions, and computer means operatively connected to said sensing means for comparing the amounts of energy expended in each of said fields and adjusting the speed of said drive means as a function of the adjacent ones of said fields exhibiting the greatest difference in expended energy.

4. Apparatus in accordance with claim 3 wherein said treatment fields include a fan, said heating means being disposed at the suction side of said fan, and said temperature measuring means being located at the compression side of said fan.

5. Apparatus in accordance with claim 4 and including means responsive to said temperature measuring means for adjusting said valve means to thereby maintain the temperature in said fields at a selected level.

* * * * *